US005109928A

United States Patent [19]

McCants

[11] Patent Number: 5,109,928

[45] Date of Patent: May 5, 1992

[54] METHOD FOR PRODUCTION OF HYDROCARBON DILUENT FROM HEAVY CRUDE OIL

[76] Inventor: Malcolm T. McCants, 2400 Augusta, Suite 260, Houston, Tex. 77057

[21] Appl. No.: 569,020

[22] Filed: Aug. 17, 1990

[51] Int. Cl.[5] ..... E21B 43/40

[52] U.S. Cl. ..... 166/266; 166/267; 166/302; 208/106

[58] Field of Search ..... 166/266, 267, 268, 305.1, 166/306, 75.1, 302; 208/106

[56] References Cited

U.S. PATENT DOCUMENTS

| | | | |
|---|---|---|---|
| 2,878,874 | 3/1959 | Allen | 166/266 |
| 3,228,467 | 1/1966 | Schlinger et al. | 166/266 |
| 3,254,712 | 6/1966 | Sharp . | |
| 3,549,519 | 12/1970 | Munro et al. | 208/106 X |
| 3,780,805 | 12/1973 | Green | 166/266 |
| 3,945,435 | 3/1976 | Barry | 166/267 |
| 4,008,764 | 2/1977 | Allen | 166/266 |
| 4,079,590 | 3/1978 | Sheinbaum . | |
| 4,119,149 | 10/1978 | Wu | 166/266 |
| 4,223,728 | 9/1980 | Pegg | 166/266 |
| 4,284,139 | 8/1981 | Sweaney | 166/267 |
| 4,362,212 | 12/1982 | Schulz | 166/245 |
| 4,407,367 | 10/1983 | Kydd | 166/267 |
| 4,418,752 | 12/1983 | Boyer et al. | 166/267 |
| 4,461,350 | 7/1984 | Hunt | 166/272 |
| 4,465,138 | 8/1984 | Hunt | 166/303 |
| 4,550,779 | 11/1985 | Zakiewicz | 166/248 |
| 4,756,368 | 7/1988 | Ikuta et al. | 166/267 |
| 4,883,582 | 11/1989 | McCants | 208/106 |

OTHER PUBLICATIONS

Process Heat Transfer by Donald Q. Kern pp. 674–675, 678–679, 686–687 (1950).

The Chemical Technology of Petroleum by W. A. Gruse and D. R. Stevens pp. 380–413 (1942).

*Primary Examiner*—George A. Suchfield

*Attorney, Agent, or Firm*—Shlesinger, Arkwright & Garvey

[57] ABSTRACT

A method of producing hydrocarbon diluent from heavy crude oil, comprises pre-heating the crude oil to produce a heated crude oil, separating in a separator vessel by flashing the heated crude oil to produce a first vapor fraction and a first liquid fraction, thermally cracking in a cracking unit at least a portion of the first liquid fraction to produce a first liquid effluent, quenching the first liquid effluent, recycling at least a portion of the quenched first liquid effluent into a separator, condensing the first vapor fraction, and separating in a separator vessel the condensed vapor fraction to produce the hydrocarbon diluent and gas.

32 Claims, 4 Drawing Sheets

METHOD FOR PRODUCTION OF HYDROCARBON DILUENT FROM HEAVY CRUDE OIL

FIELD OF THE INVENTION

This invention relates to the enhanced recovery of heavy crude oil from underground formations and in particular to the continual production of a hydrocarbon diluent from such crude oils for reinjection into the oil formation.

BACKGROUND OF THE INVENTION

A great deal of effort has been devoted to devising what has been termed secondary recovery methods to increase the efficiency of extraction of oil from the underground deposits. This problem is particularly apparent when recovering heavy crude oils within the range of 0° to 20° API. These oils are highly viscous and not generally productive in their natural state. Thus, an ongoing problem in the oil industry is to develop methods to lower the viscosity of oils prior to their being pumped from the underground deposit.

In the prior art, several processes for decreasing the viscosity of the crude oil in situ have been developed. For example, in the so-called "huff and puff" process, a high pressure steam is cyclically injected into a well followed by production phase recovery of the lower viscosity oil. Viscosity can also be lowered by such methods as steam flooding, surfactant flooding, polymer flooding, in situ combustion and carbon dioxide flooding. These prior art processes are expensive and the cost of such flooding is usually excessive in relation to the oil production obtainable thereby.

Another way to lower the crude oil viscosity is to use a low viscosity diluent solvent which is extracted from the crude oil followed by reinjection back into the production well. The advantage of this approach is the continuous supply of fresh diluent solvents. U.S. Pat. No. 4,418,752 (Boyer, et al) is directed to a process for the production of heavy oil by injecting a diluent solvent down the production well to produce a blend of a decreased viscosity. At the surface, the blend is treated in order to recover the solvent which is then recycled back into the production well to be mixed with the heavy oil. The diluent solvent preferably is a gas oil cut produced by fractional distillation of the recovered crude oil.

U.S. Pat. No. 4,284,139 (Sweany) discloses a process for upgrading oil production from a heavy oil reservoir wherein the heavy oil produced is combined with a diluent and subjected to thermal cracking. The thermally cracked products are fractionated to produce, inter alia the intermediate liquid and gas oil fractions, and a portion of the gas oil fraction is hydrogenerated with a hydrogen-containing gas stream to produce the diluent to be combined with the heavy crude oil. U.S. Pat. No. 4,362,212 (Schultz) discloses an enhanced oil recovery method wherein a liquid mixture of lower molecular weight hydrocarbons is injected into the underground deposit. The hydrocarbons are recovered from the mixture with the petroleum oil, separated by distillation and recycled back into the injection step. The diluent hydrocarbons employed in the process are those containing 2–5 carbon atoms.

In U.S. Pat. No. 4,883,582 (McCants) viscosity reduction is effected by using reactors for partially cracking the crude oil followed by mixing the products of the cracked crude oil with the untreated crude oil to yield a flowable, relatively low viscosity mixture.

OBJECTS AND SUMMARY OF THE INVENTION

The present invention reduces the difficulties and disadvantages of the prior art by providing a method and apparatus for extracting a middle fraction hydrocarbon diluent having a boiling point between 400°–700° F. This middle fraction diluent can then be reinjected back into the production well lowering the viscosity of the heavy crude oil and thereby increase recovery of the crude oil.

Another object of this invention is to incorporate a carbon removal cycle incorporated into the diluent extraction process to remove carbon and coke deposits on the inside of the thermal cracking heat exchanger tubes thereby improving the yield of diluent for the injection well.

An additional object of this invention is to provide a continuous method for recovery of middle fraction diluent which is then reinjected into the production well on a continual basis thereby increasing production efficiency.

Yet another object of this invention is to reduce the danger of precipitating asphaltenes in the formation by continuously removing the middle fractions from the heavy crude oil.

Still another object of this invention is to increase the energy efficiency of the distillation process by recycling the heat and gases produced with other steps in the process thereby reducing total energy consumption.

The present invention relates to a method for the production of hydrocarbon diluent from heavy crude oil comprising the steps:

a) preheating the crude oil to produce a heated crude oil;

b) separating in a separator vessel by flashing the heated crude oil to produce a first vapor fraction and a first liquid fraction;

c) thermally cracking in a cracking unit at least a portion of said first liquid fraction to produce a cracked liquid effluent fraction;

d) quenching said cracked liquid effluent fraction;

e) recycling at least a portion of said quenched fraction back into said separator;

f) condensing said first vapor fraction; and, g) separating said condensed vapor fraction to yield a liquid hydrocarbon diluent and gas.

DESCRIPTION OF THE PREFERRED EMBODIMENT

FIG. 1

Figure 1:
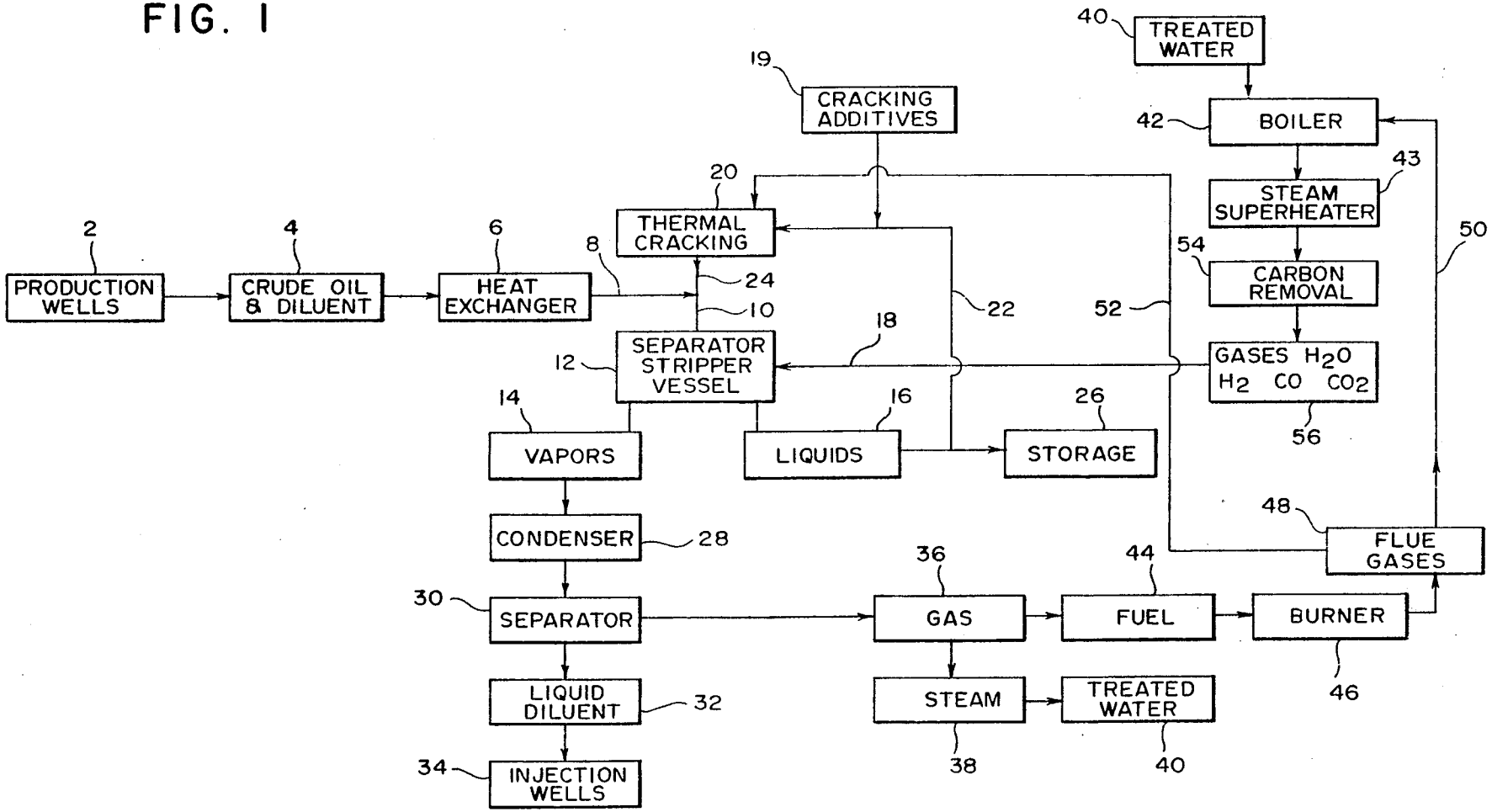
FIG. 1 is a schematic diagram illustrating the method and apparatus for recovering diluent according to the present invention.

Referring now to FIG. 1, a production well 2 extracts untreated crude oil for from an underground oil deposit. (Untreated crude oil is intended to mean oil which has not been treated in the apparatus or by using the process of the present invention). The oil is any high viscosity and/or high pour point crude oil or any other type of similar hydrocarbon deposit. Such high viscosity crude oils are generally characterized having a density on the API scale between 0° to 20° API. Usually the oil will be a crude oil from a production tank or pit and has already been de-sanded and de-watered in an oil field separator. The crude oil may, however, further include a diluent which has been injuected into the well. The untreated crude oil diluent 4 is preheated by flue gas heat exchanger 6 between around 600°-650° F. and enters line 8 as a preheated crude oil stream. The preheated crude oil enters a separator-stripper vessel 12 via line 10. The separator-stripper vessel 12 includes a suitable stripping section consisting of conventional valve cap trays or equivalent packing. Steam via line 18 is introduced into the lower portion of the separator-stripper vessel 17. The preheated crude oil is thereby flashed into a first vapor fraction 14 and a first liquid fraction 16. The liquid fraction contains the lighter, lower boiling hydrocarbon components.

The first liquid fraction 16 exiting the separator-stripper vessel 12 is fed via line 22 into thermal cracking heat exchanger means 20 where the liquid fraction is cracked. The cracking process is conventional in the art whereby heavy hydrocarbon components are broken down into lighter hydrocarbon components by subjecting the liquid to high heat (700°-1,000° F.) and pressure (100-300 psig) in the presence of a cracking additive 19. A cracked effluent, having a boiling point between around 700°-800° F. leaves the thermal cracking unit 20 via line 24. The cracked effluent in line 24 is then quenched by the preheated crude oil/diluent stream in line 8 preventing further cracking as the fluid enters separator-stripper vessel 12. This separator-stripper vessel and thermal cracking cycle continually produce a first liquid fraction 16 a portion of which is cooled for storage at 26 or for use as a naphtha or other hydrocarbon byproducts fuel. The first vapor fraction 14 leaving the separator-stripper vessel 12 enters a condenser 28 where the stripped hydrocarbon vapor in steam mixture is partially cooled to a temperature of about 350°-400° F. The cooled vapors then enter separator 30 where the higher boiling liquid fraction begin to condense. This hot liquid middle fraction, having a boiling point between 400°-700° F. is the liquid diluent 32. The liquid diluent is then pumped into the injection wells 34 for mixture downhole with the crude oil to lower its viscosity and increase pumpability.

The vapors which do not condense from separator 30 are further cooled to around 100°-120° F. recovering non-condensed hydrocarbon gases 36 as well as naphtha and steam residue 38. This steam is further condensed and treated for recycle as treated water 40 in boiler 42. The non-condensed gases from the separator 30 contain light hydrocarbons from the thermal cracking cycle, unreacted hydrogen and carbon monoxide, etc. All of these gases are burned as fuel 44 in burner 46. The resultant flue gases 48 are further used to heat the boiler 42 via line 50 as well as to provide heat for the thermal cracking heat exchanger 20 via line 52.

Because thermal cracking of petroleum oil will cause deposit of carbon or coke on the inside of thermal cracking heat exchanger tubes 20, the present invention incorporates a carbon removal step utilizing superheated steam. Steam generated in boiler 42 is superheated in the steam superheater heat exchanger 43 between around 1000°-1200° F. This steam is then introduced periodically into the thermal cracking heat exchanger tubes via suitable valving and fluid connections (not shown). Thus, the thermal cracking heat exchanger unit 20 can be switched from cracking operation to regeneration, in which the superheated steam is introduced to remove the coke deposits. The individual valving on each of the thermal cracking tubes units allows continuous carbon removal during the cracking process. The gases 54 produced during the carbon removal cycle, include hydrogen, carbon monoxide, carbon dioxide as well as steam. These gases are cooled in appropriate heat exchanger means (not shown) to approximately 650°-700° F. Hydrogen gas is concentrated using pressure swing adsorbtion similar methods. The remaining steam is introduced into the separator-stripper vessel 12 via line 18 and used to strip the crude oil in the separator 12.

EMBODIMENT SHOWN IN FIG. 2

Figure 2:
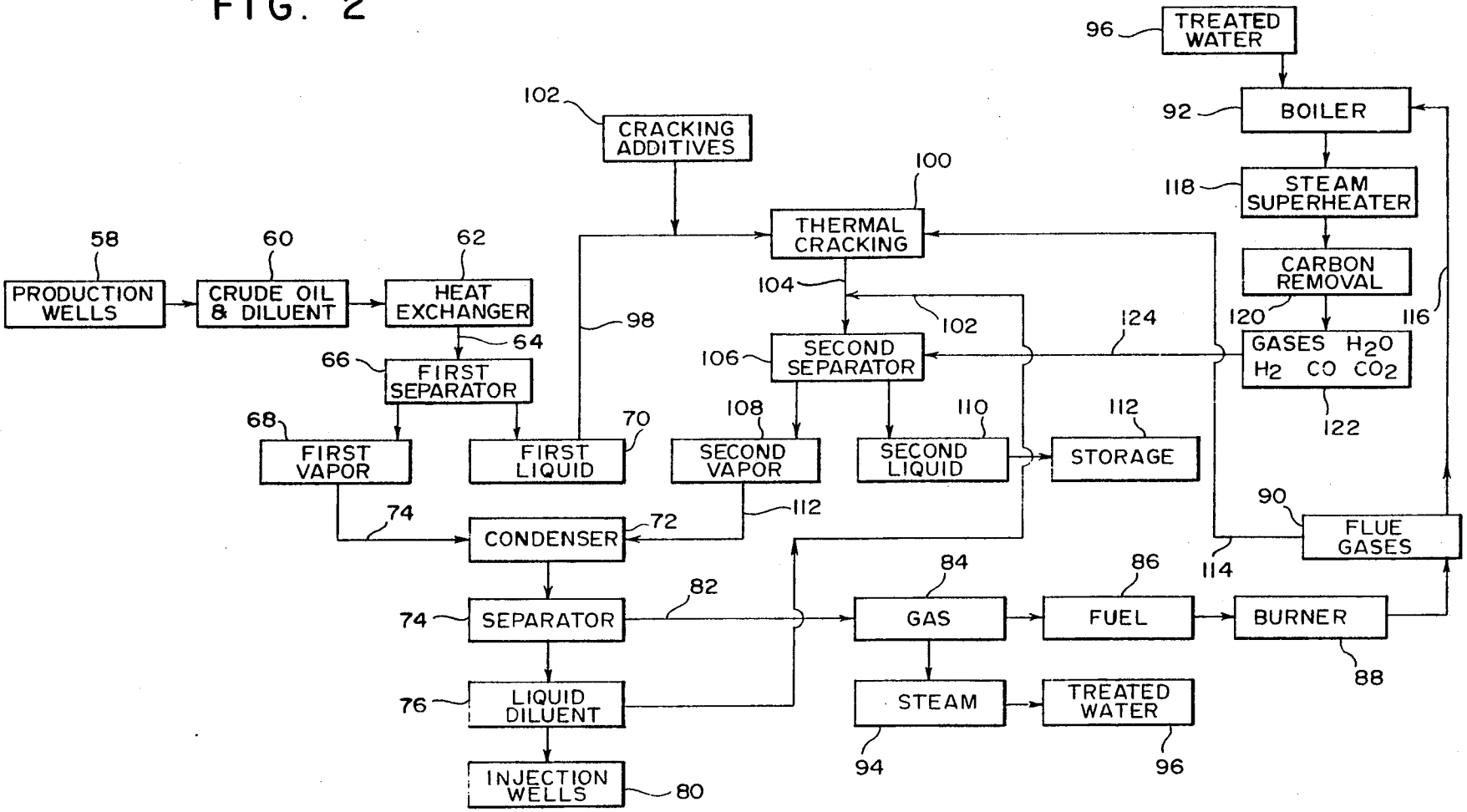
FIGS. 2, 3 and 4 diagramatically illustrate modifications of the present invention.

Another embodiment of the present invention is depicted in FIG. 2. A production well 58 extracts an untreated crude oil/diluent 60 which is preheated prior to being fed into a flue gas heat exchanger 62. The temperature of the crude is raised to about 600°-650° F. as it enters outlet line 64. The flue gas entering the heat exchanger 62 (not shown) is derived from burning byproduct gases obtained while extracting the liquid diluent. The vapors and liquid residue leave the flue gas heat exchanger 62 via line 64 and are flashed in a first separator-stripper vessel 66. The construction of the first separator-stripper vessel 66 is similar to that described in FIG. 1. The fluid exiting the first separator-stripper vessel 66 is divided into a first vapor fraction 68 and a first liquid fraction 70. The first vapor fraction 68 enters condenser 72 via line 74 and is cooled to 350°-400° F. The cooled gases and liquid exiting condenser 72 enter a separator 74 which extracts the liquid diluent middle boiling (400°-700° F.) fraction 76 for use in the injection well 80. The non-condensed hydrocarbon gases 84 are further cooled to about 100°-120° F. and are used as a fuel 86 for burner 88 to create flue gases 90. The steam 94 is condensed and treated 96 for use with boiler 92 (not shown).

The first liquid fraction 70 containing the lower boiling components is sent via line 98 to thermal cracking heat exchangers 100. This first liquid fraction is cracked in the presence of cracking additives 102 at a temperature of around 700°-800° F. A portion of the extracted liquid diluent 76 is directed via line 102 to quench liquid effluent exiting the thermal cracking heat exchanger at line 104. This quenched liquid fraction enters a second separator-stripper vessel 106 via line 104 which operates to strip the cracked effluent into a second vapor fraction 108 and a second liquid fraction 110. The second vapor fraction 108 is sent via line 112 to the condenser 72 where it is combined with the first vapor fraction for subsequent separation into a gas fraction 84 and a liquid diluent middle boiling (400°-700° F.) fraction 76. The second liquid fraction 110 comprising the lower boiling point fractions is cooled and sent to storage 112. The stored liquid can then be used as a fuel or to make asphalt or other similar petroleum byproducts.

The flue gases 90 resulting from burner 88 are directed to provide heat for thermal cracking heat exchanger 100 via line 114. The flue gases are also directed via line 116 to drive boiler 92 as well as heat exchanger 62 (not shown). The carbon removal cycle is similar to that described with respect to FIG. 1. Treated water 96 enters the boiler 92 where it is directed to a steam super heater 118 increasing the temperature of the steam to 1000°-1200° F. The carbon removal cycle is indicated at 120 and comprises alternatively closing the cracking unit heat exchanger tubes 100 to the crude oil while flushing the tubes with the superheated steam. The resultant gases 122, include steam, hydrogen, carbon monoxide and carbon dioxide. The gases are cooled in appropriate heat exchange means (not shown) to approximately 650°-700° F. Hydrogen gas may then be concentrated using pressure swing absorption or similar methods. The remaining steam is directed via line 124 into the second separator-stripper 106 and functions as a stripping steam.

EMBODIMENT SHOWN IN FIG. 3

Figure 3:
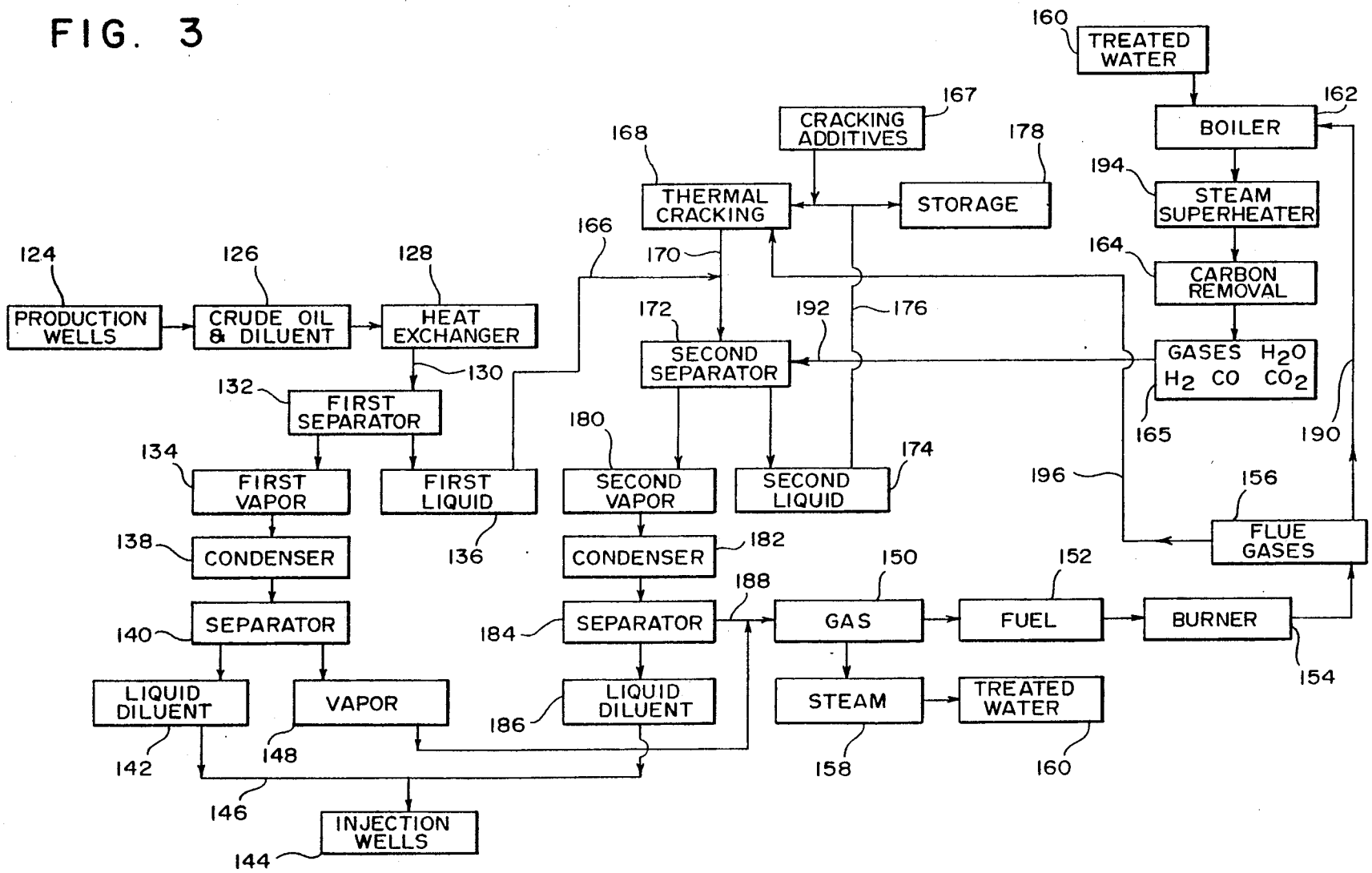

Referring now to FIG. 3, which illustrates another embodiment of the present invention, the production well 124 extracts a crude oil mixed with diluent 126 which is heated in a flue gas heat exchanger 128 to a temperature of around 600°-650° F. at outlet line 130. Flue gas is diverted to the heat exchanger, as indicated above, from a burner 154 incorporated in separate portions of the apparatus. The preheated crude and diluent mixture enters a first separator-stripper vessel 132 where the oil is flashed to yield a first vapor fraction 134 and a first liquid fraction 136. The first vapor fraction 134 is further directed to a condenser heat exchanger 138 where the stripped hydrocarbon vapors are partially cooled to about 350°-400° F. The cooled vapor is sent to a separator 140 where the middle boiling (400°-700° F.) fraction components begin to condense. This middle fraction is the liquid diluent. The liquid diluent is then sent to the injection well 144 via line 146 to lower the viscosity of the downhole crude oil. The non-condensed gas vapors 148 which leave separator 140 are allowed to cool 100°-120° F. followed by recovery of both naphtha and water. Any remaining non-condensed hydrocarbon gases 150 are used as fuel 152 for a burner 154 creating flue gases 156. These flue gases are then used for heating the thermal cracking unit 168 via line 196 as well as the boiler 162 line 190. Steam 158 is extracted from the gas stream 150 where it is treated 160 and recycled to a boiler 162 for use in the carbon removal step 164.

The first liquid fraction 136 is directed via line 166 to quench the thermal cracking heat exchanger effluent output line 170. This cracked effluent which has been cooled enters a second separator-stripper vessel 172 which has similar construction to the first separator-stripper vessel 132. The mixture of quenched, cracked effluent in line 170 enters the second separator 172 where the second liquid fraction 174 is stripped by steam and gases entering the lower portion of the separator via line 192. The stripped liquid is recycled back to the thermal cracking unit 168 via line 176. Cracking additives 167 are added to stream 176. A portion of the second liquid fraction is also directed to storage 178. The stored second liquid fraction is cooled and then used as a fuel or to make asphalt o similar hydrocarbon byproducts. The second vapor fraction 180 is cooled in a condenser unit 182 to a temperature between around 350°-400° F. This partially cooled vapor enters a separator 184 where the higher boiling (400°-700° F.) middle fractions condense out as the liquid diluent fraction 186. This hot diluent is combined with the first diluent stream 146 for injection into the well 144. After removal of the liquid diluent fraction, the vapors are combined with vapor stream 188 where the non-condensed hydrocarbon gases 150 are used as fuel in burner 154 to produce flue gases 156. Steam 158 is removed from the gas stream, treated 160, and reintroduced into boiler 162 for use in the carbon removal step 164.

The carbon removal cycle is similar to that described in FIG. 1 and 2. The flue gases 156 resulting from burner 154 are directed by line 190 to a boiler 162. Steam leaving the boiler enters a superheater 194 where the temperature of the steamer is raised between 1000° F.-1200° F. Carbon removal 164 is commenced by directing the superheated steam into the tubes of the thermal cracking unit 168. Carbon removal is conducted simultaneously with the cracking process by shutting off the individual tubes via valve means (not shown) followed by flushing with the super heated steam. Steam and gases produced 165 such as hydrogen, carbon dioxide and carbon monoxide, are cooled (650°-750° F.) in appropriate means (not shown). Hydrogen gas may then be concentrated using pressure swing adsorption or similar methods. The remaining steam is directed via line 192 into separator-stripper 172.

EMBODIMENT SHOWN IN FIG. 4

Figure 4:
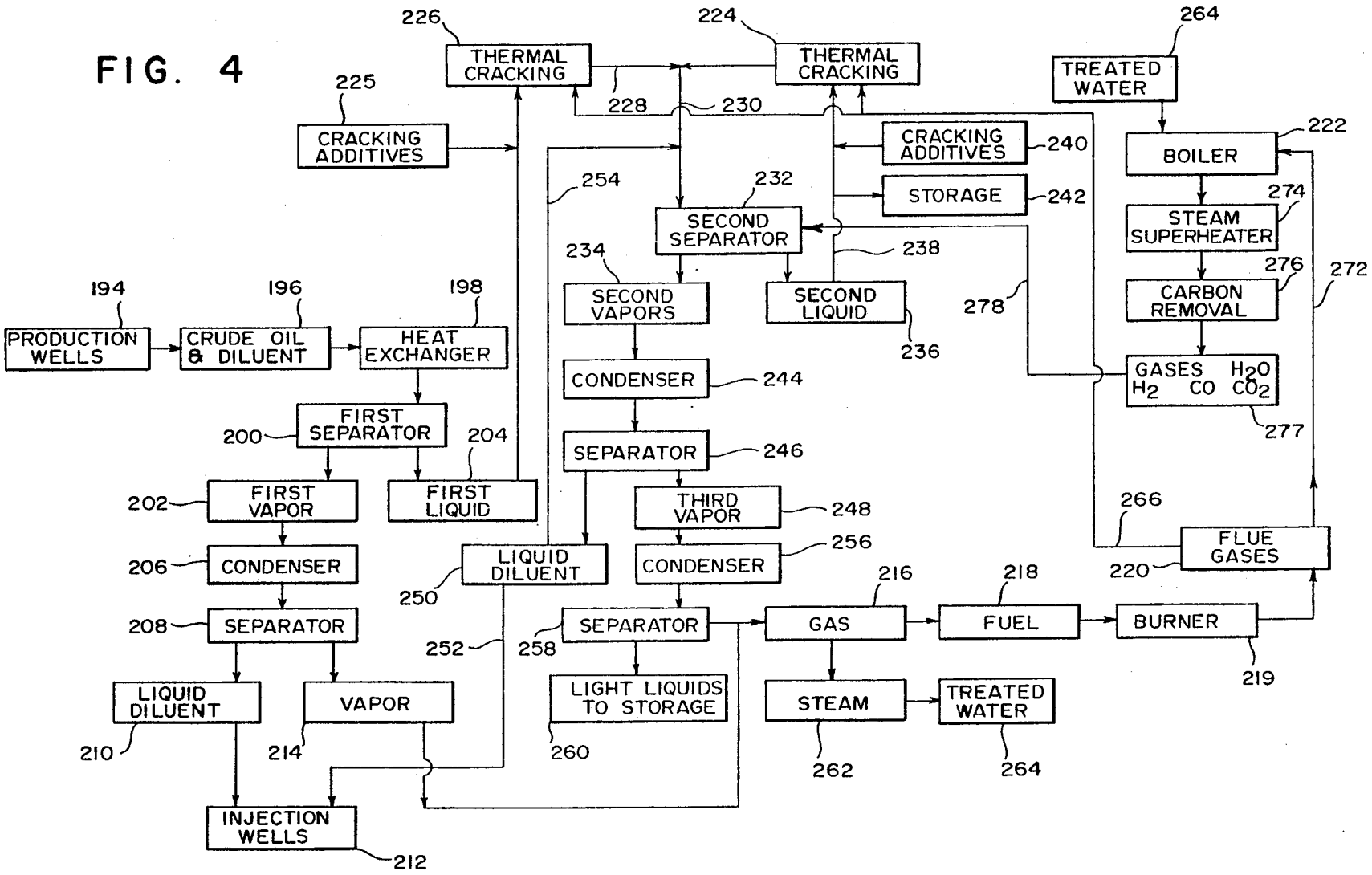

Referring now to FIG. 4, which illustrates a further embodiment of the present invention, a production well 194 produces an untreated crude oil and diluent stream 196 which is preheated and directed to a flue gas heat exchanger 198. The crude oil leaves the heat exchanger at a temperature between 600°-650° F. and enters a first separator-stripping vessel 200. The crude oil is flashed in this first separator-stripping vessel into a first vapor fraction 202 and a first liquid fraction 204. The construction of the first separator-stripper vessels is similar to those describes in FIGS. 1. The first vapor fraction 202 is partially cooled in condenser heat exchanger 206. The cooled vapors are directed to a separator 208 where the middle fractions boiling between 400°-700° F. are removed as a hot liquid diluent 210. The diluent is then directed to injection well 212 for downhole mixing with the crude oil. The remaining non-condensed vapors 214 are further cooled to around 100°-120° F. recovering naphtha as well as water. Any non-condensible hydrocarbon gas 216 remaining is used as a fuel 218 for burner 219 creating flue gases 220 for boiler 222 and a thermal cracking unit 224.

The first liquid fraction 204 is thermally cracked in thermal cracking heat exchanger 226 at temperature between 700°-800° F. Cracking additives 225 are added to the stream prior to cracking. The cracked effluent exits the cracking unit via line 228 and enters line 230 where it is directed into a second separator-stripper vessel 232. The separator vessel constructive is similar to that outlined in FIG. 1. The cracked effluent entering the second separator-stripper vessel is flashed between around 600° F. and 700° F. resulting in a second vapor fraction 234 and a second liquid fraction 236. This second liquid fraction 236 is recycled via line 238 into thermal cracking heat exchanger 224. The second liquid fraction 236 is continually cracked and recycled via line 230 into the second separator-stripper unit 232. Cracking additives 240 are supplied to the thermal cracking cycle. The lower boiling fractions of the second liquid fraction 236 are cooled sufficiently and sent to storage 242. This cooled liquid fraction can be used for producing asphalt or similar petroleum byproducts. The second vapor fraction 234 is cooled in a condenser heat exchanger 244 to a temperature around 300°-400° F. These partially cooled vapors then enter a separater 246 the vapors are separated into a third vapor fraction 248 and a middle boiling fraction 250. The liquid diluent fraction 250 is then sent via line 252 for use in injection well 212. A portion of the liquid diluent 250 is also directed via line 254 into the cracked effluent line 230 to quench the effluent and prevent further cracking prior to entrance of the fluid into the second separator-stripper unit 232.

The third vapor fraction 248 is further condensed and separated in condenser heat exchanger 256 followed by a separator 258. The remaining light liquid fraction are condensed between 100°-120° F. and are recovered as naphtha fuel and storage 260. The non-condensible hydrocarbon gases 216, exiting separator 258 are burned as fuel 218 in burner 219 producing flue gas 220. The remaining steam 262 is condensed and treated 264 for use in the boiler 222. A portion of the flue gas 220 is sent via line 266 to provide heat for the thermal cracking heat exchangers 224 and 226.

A carbon removal cycle for cleaning thermal cracking units 226 and 224 is provided. The arrangement 15 similar to that indicated in FIG. 1. The flue gases 220 are directed to boiler 222 via line 272. The steam exiting boiler 222 enters a super heater 274 which raises the temperature of the steam to 1000°-1200° F. as it enters the thermal cracking unit (not shown). The carbon removal 276 occurs when the superheated steam enters the individual thermal cracking heat exchanger tubes. The heat exchanger tubes can be cleaned individually while the remaining tubes continue to operate in the cracking process. Conventional valve means are associated with the individual tubes of the thermal cracking units 224 and 226 as well as appropriate fluid connections between the superheater 274 (not shown). The resultant steam and gases 277 include hydrogen, carbon dioxide, and carbon monoxide ar[illegible]led in appropriate means (not shown). The remaini[illegible]am is directed via line 278 to a second separator-stripping vessel 232 to aid in the stripping process of the cracked effluent.

While this invention has been disclosed has having a preferred design, it is understood that it is capable of further modifications, uses and/or adaptations of the invention following in general the principle of the invention an including such departures from the present disclosure as come within known or customary practice in the art to which the invention pertains, and as may be applied to the central features hereinbefore set forth, and fall within the scope of the invention of the limits of the appended claims.

What I claim is:

1. A method of producing a hydrocarbon diluent from a heavy crude oil extracted from an underground petroleum formation via a production well comprising the steps of:

a) preheating a quantity of heavy crude oil extracted from the production well to yield a heated crude oil;

b) separating in a separator vessel by flashing the heated crude oil to produce a first vapor fraction and a first liquid fraction;

c) thermally cracking in a cracking unit at least a portion of the first liquid fraction to produce a first liquid effluent;

d) quenching the first liquid effluent;

e) introducing at least a portion of the quenched fist liquid effluent into a separator;

f) condensing the first vapor fraction;

g) separating in a separator vessel the condensed vapor fraction to produce a liquid hydrocarbon diluent middle fraction characterized in having a boiling range between about 400°-700° F. and a gas; and, h) directing the liquid hydrocarbon diluent into the formation via an injection well for enhancing production of petroleum from the formation via the production well.

2. A method according to claim 1 and further including the steps of:

a) burning the gas to provide heat for the separator vessel and the cracking unit.

3. A method according to claim 1 wherein the crude oil is preheated to a temperature of about 600°-650° F.

4. A method according to claim 3 wherein the first liquid effluent is quenched by the preheated crude oil.

5. A method according to claim 1 wherein the first liquid effluent has a range of boiling points between about 700°-800° F.

6. A method according to claim 1 wherein the first vapor fraction is condensed at a temperature between about 350°-400° F.

7. A method according to claim 1 wherein the gas has a boiling range between about 100°-120° F.

8. A method of producing a hydrocarbon diluent from a heavy crude oil extracted from an underground petroleum formation by a production well comprising the steps of:

a) preheating a quantity of heavy crude oil extracted from the production well to yield a heated crude oil;

b) separating in a separator vessel by flashing the heated crude oil to produce a first vapor fraction and a first liquid fraction;

c) introducing the first liquid fraction directly into a cracking unit;

d) thermally cracking in the cracking unit at least a portion of the first liquid fraction to produce a first liquid effluent;

e) separating in a second separator vessel by flashing the first liquid effluent to produce a second vapor fraction and a second liquid fraction;

f) mixing the first vapor fraction with the second vapor fraction;

g) condensing the mixed vapor fractions;

h) separating in the separator vessel the condensed mixed vapor fractions to produce a liquid hydrocarbon diluent and a gas; and, i) directing the liquid hydrocarbon diluent into the formation via an injection well for enhancing production of petroleum from the formation via the production well.

9. A method according to claim 8 and further including the steps of:

a) burning the gas to provide heat for the second separator vessel and the cracking unit.

10. A method according to claim 8 wherein the crude oil is preheated to a temperature of about 600°-650° F.

11. A method according to claim 8 wherein the first liquid effluent has a range of boiling points between about 700°-800° F.

12. A method according to claim 8 wherein hydrocarbon diluent is the middle fraction characterized in having a boiling range between about 400°-700° F.

13. A method according to claim 8 wherein the first vapor fraction is condensed at a temperature between about 350°-400° F.

14. A method according to claim 8 wherein the first liquid effluent is quenched by the hydrocarbon diluent.

15. A method according to claim 8 wherein the gas has a boiling range between about 100°-120° F.

16. A method of producing a hydrocarbon diluent from a heavy crude oil extracted from an underground petroleum formation via a production well comprising the steps of:

a) preheating a quantity of heavy crude oil extracted from the production to well to yield a heated crude oil;

b) separating in a separator vessel by flashing the heated crude oil to produce a first vapor fraction and first liquid fraction;

c) mixing said first liquid fraction with a thermally cracked liquid effluent stream to yield a combined liquid stream;

d) separating in a second separator vessel by flashing the combined liquid stream to produce a second vapor fraction and a second liquid fraction;

e) thermally cracking in a cracking unit at least a portion of the second liquid fraction to produce the thermally cracked liquid effluent stream;

f) condensing the second vapor fraction;

g) separating in a separator vessel the condensed second vapor fractions to produce a liquid hydrocarbon diluent and a gas; and, h) directing the liquid hydrocarbon diluent into the formation via an injection well for enhancing production of petroleum from the formation via the production well.

17. A method according to claim 16 and further including the steps of:

a) burning the gas to provide heat for the second separator vessel and the cracking unit.

18. A method according to claim 16 wherein the crude oil is preheated to a temperature of about 600°-650° F.

19. A method according to claim 16 wherein the first liquid effluent has a range of boiling points between about 700°-800° F.

20. A method according to claim 16 wherein hydrocarbon diluent is the middle fraction characterized in having a boiling range between about 400°-700° F.

21. A method according to claim 16 wherein the first vapor fraction is condensed at a temperature between about 350°-400° F.

22. A method according to claim 16 wherein the first liquid effluent is quenched by the first liquid fraction.

23. A method according to claim 16 wherein the gas has a boiling range between about 100°-120° F.

24. A method producing a hydrocarbon diluent from a heavy crude oil extracted from an underground petroleum formation via a production well comprising the steps of:

a) preheating a quantity of heavy crude oil extracted from the production well to yield a heated crude oil;

b) separating in a first separator vessel by flashing the heated crude oil to produce a first vapor fraction and a first liquid fraction;

c) introducing the first liquid fraction directly into a cracking unit;

d) thermally cracking in the cracking unit at least a portion of the first liquid fraction to produced a first liquid effluent;

e) separating in a second separator vessel by flashing the first liquid effluent to produce a second vapor fraction and a second liquid fraction;

f) thermally cracking in a second cracking unit the second liquid fraction to produce a second liquid effluent;

g) mixing the first liquid effluent and the second liquid effluent;

h) introducing the mixed liquid effluents into the second separator vessel;

i) condensing the second vapor fraction;

j) separating in a separator vessel the condensed second vapor fraction to produce a liquid hydrocarbon diluent and a third vapor fraction;

k) condensing the third vapor fraction;

l) separating in a separator vessel the condensed third vapor fraction to produce a light liquid hydrocarbon fuel and a gas; and, m) directing the liquid hydrocarbon diluent into the formation via an injection well for enhancing production of petroleum from the formation via the production well.

25. A method according to claim 24 and further including the steps of:

a) burning the gas to provide heat for the second separator, vessel, the cracking unit and the second cracking unit.

26. A method according to claim 24 wherein the crude oil is preheated to a temperature of about 600°-650° F.

27. A method according to claim 24 wherein the first liquid effluent has a range of boiling points between about 700°-800° F.

28. A method according to claim 24 wherein hydrocarbon diluent is the middle fraction characterized in having a boiling range between about 400°-700° F.

29. A method according to claim 24 wherein the first vapor fraction is condensed at a temperature between about 350°-400° F.

30. A method according to claim 29 wherein the second vapor fraction is condensed at a temperature between 300°-400° F.

31. A method according to claim 24 wherein the first liquid effluent is quenched by the hydrocarbon diluent.

32. A method according to claim 24 wherein the gas has a boiling range between about 100°-120° F.

* * * * *